US009174775B2

(12) United States Patent
Foshee et al.

(10) Patent No.: US 9,174,775 B2
(45) Date of Patent: Nov. 3, 2015

(54) ACTUATOR-DRIVEN DISPENSER

(75) Inventors: David L. Foshee, Raleigh, NC (US); Theodore J. Mosler, Raleigh, NC (US); Eileen Ventura, Durham, NC (US); Kristin L. Benokraitis, Durham, NC (US); Matthew R. Penny, Cary, NC (US)

(73) Assignee: Elix, LLC, Delray Beach, FL (US)

( * ) Notice: Subject to any disclaimer, the term of this patent is extended or adjusted under 35 U.S.C. 154(b) by 239 days.

(21) Appl. No.: 13/701,648

(22) PCT Filed: Jun. 3, 2011

(86) PCT No.: PCT/US2011/039186

§ 371 (c)(1),
(2), (4) Date: Aug. 23, 2013

(87) PCT Pub. No.: WO2011/153511

PCT Pub. Date: Dec. 8, 2011

(65) Prior Publication Data

US 2013/0327789 A1 Dec. 12, 2013

Related U.S. Application Data

(60) Provisional application No. 61/351,145, filed on Jun. 3, 2010, provisional application No. 61/406,411, filed on Oct. 25, 2010.

(51) Int. Cl.

| | |
|---|---|
| ***B65D 35/28*** | (2006.01) |
| ***A61J 7/00*** | (2006.01) |
| *A61J 1/03* | (2006.01) |

(52) U.S. Cl.

CPC ..... *B65D 35/28* (2013.01); *A61J 7/0076* (2013.01); *A61J 1/03* (2013.01)

(58) Field of Classification Search

CPC ..... B65D 35/28; A61M 5/14232; A61M 2005/14506; A61M 2005/14533

USPC ..... 222/95, 99, 100, 101, 105, 107, 325, 222/326, 386, 391, 410, 414; 604/131, 132, 604/209, 214, 232, 235; 417/474, 476, 417/477.7

See application file for complete search history.

(56) References Cited

U.S. PATENT DOCUMENTS 4,525,164 A * 6/1985 Loeb et al. ..... 604/131
4,865,231 A * 9/1989 Wiercinski ..... 222/390

(Continued)

FOREIGN PATENT DOCUMENTS

| | | | |
|---|---|---|---|
| JP | 2002522311 | A | 7/2002 |
| WO | 02/092462 | A1 | 11/2002 |
| WO | 2007/079256 | A1 | 7/2007 |

OTHER PUBLICATIONS

The International Bureau of WIPO, PCT International Preliminary Report on Patentability and Written Opinion of the International Searching Authority for International Application No. PCT/US2011/039186 dated Dec. 4, 2012.

*Primary Examiner* — Paul R Durand
*Assistant Examiner* — Benjamin R Shaw
(74) *Attorney, Agent, or Firm* — Christopher J. Knors; Moore & Van Allen PLLC

(57) ABSTRACT

Dispenser and methods of dispensing substances is provided. The dispenser comprises a housing having a longitudinal axis, the housing configured to receive a packet comprising at least one collapsible cavity containing at least one substance, a support member positioned in the housing, the support member having a longitudinal axis essentially parallel to the longitudinal axis of the housing, a wedge coupled to the support member, the wedge configured to move in a plane substantially parallel within the longitudinal axis of the housing, the wedge receiving a force directed substantially normal to the longitudinal axis of the housing, and a reciprocating actuator coupled to the housing and engagable with the support member, the actuator moveable between a first position and a second position whereby the wedge advances a single predetermined increment collapsing a portion of the cavity.

15 Claims, 19 Drawing Sheets

(56) References Cited

U.S. PATENT DOCUMENTS 6,019,251 A * 2/2000 Koga ..... 222/94
2004/0054326 A1* 3/2004 Hommann et al. ..... 604/131
2010/0168672 A1* 7/2010 Carr ..... 604/153
2011/0089193 A1* 4/2011 Minegishi ..... 222/102

* cited by examiner

ACTUATOR-DRIVEN DISPENSER

CROSS-REFERENCE TO RELATED APPLICATIONS

This application is filed under the provisions oF 35 U.S.C. §371 and claims the benefit of International Patent Application No. PCT/US2011/039186. filed on Jun. 3, 2011, which claims the benefit of U.S. Provisional Application Nos. 61/351,145, filed on Jun. 3, 2010; and 61/406,411, filed Oct. 25, 2010; all of which are hereby incorporated by reference in their entirety.

TECHNICAL FIELD

This invention relates to a dispenser configured for the delivery of a substance in metered amounts.

BACKGROUND

Many substances are provided in tubes or other deformable dispensers that tend to leave behind an appreciable amount of material. Many expensive pharmaceuticals require such packaging due to intrinsic thermal, light, and/or oxidative sensitivity of the pharmaceutical. Current packaging to prevent or eliminate such sensitivity typically results in wasted material that cannot be accessed by the user. In addition, current packaging that primarily functions to protect the contents thereof is not designed or capable of metered dispensing.

SUMMARY

In a first embodiment, a dispenser is provided. The dispenser comprises a housing having a longitudinal axis, the housing configured to receive a packet comprising at least one collapsible cavity containing at least one substance, a support member positioned in the housing, the support member having a longitudinal axis essentially parallel to the longitudinal axis of the housing, a wedge coupled to the support member, the wedge configured to move in a plane substantially parallel within the longitudinal axis of the housing, a bias element exerting a force on the wedge, the force directed substantially normal to the longitudinal axis of the housing. A reciprocating actuator coupled to the housing is engagable with the support member. The actuator is moveable between an initial position and a first position whereby the wedge advances a single predetermined increment thereby collapsing a portion of the cavity.

In a first aspect of the first embodiment, support member is rotatable within a plane substantially parallel to the longitudinal axis of the housing.

In a second aspect, alone or in combination with any of the previous aspects of the first embodiment, the wedge rotates in a plane substantially parallel to the longitudinal axis of the housing cooperatively with the movement of the support member.

In a third aspect, alone or in combination with any of the previous aspects of the first embodiment, the actuator reciprocates in a plane substantially parallel to the longitudinal axis of the housing and cooperatively with the movement of the wedge.

In a fourth aspect, alone or in combination with any of the previous aspects of the first embodiment, the bias element is positioned on the support member. The bias element can be at least one of a spring, a compressed elastomer, a lever, and a living hinge. The lever can comprises a first end coupled to the support member and a second end coupled to the wedge, the second end operably coupled to the bias element.

In a fifth aspect, alone or in combination with any of the previous aspects of the first embodiment, the support member comprises gear teeth operably engaged with the actuator. The dispenser can further comprise a pawl pivotably coupled to the actuator, the pawl engaging the gear teeth. The pawl can be biased against the gear.

In a sixth aspect, alone or in combination with any of the previous aspects of the first embodiment, the housing further comprises a stop allowing rotation of the support member in a first direction and substantially preventing rotation in a reverse direction. The housing can comprise a bottom portion having a wall projecting upwardly therefrom, the wall having an opening operably receiving at least a portion of the actuator.

In a seventh aspect, the support member and the actuator are stationary within the plane substantially parallel to the longitudinal axis of the housing, the actuator reciprocating in a plane substantially normal to the longitudinal axis of the housing, the actuator reciprocating from an initial position to a first position.

In an eighth aspect, alone or in combination with the seventh aspect of the first embodiment, the wedge is rotatable about the support member.

In a ninth aspect, alone or in combination with any of the seventh through eighth aspects of the first embodiment, the dispenser further comprises a non-electrical stored energy source operably coupled to the actuator to release energy when the actuator is in the first position, the stored energy source operably coupled to the wedge and providing rotation about the support member. The non-electric stored energy source can be a torsion spring or a clock spring.

In a tenth aspect, alone or in combination with any of the seventh through ninth aspects of the first embodiment, the actuator comprises a surface and an annular side wall projecting upwardly therefrom and at least partially surrounding the support member, the side wall having a plurality of interdigitally positioned stops on its internal surface engaged with the wedge. The interdigitally positioned stops can comprise a plurality of first stops engaging the wedge in the initial position and a plurality of second stops engaging the wedge while in the first position, whereby a "click-click" sequence is provided during use.

In an eleventh aspect, alone or in combination with any of the seventh through tenth aspects of the first embodiment, the bias element is positioned between the support member and the actuator, the bias element operably coupled to the actuator and support member.

In a twelfth aspect, alone or in combination with any of the seventh through eleventh aspects of the first embodiment, the housing comprises a bottom portion having a wall projecting upwardly therefrom and at least partially surrounding the actuator, the bottom portion having an opening exposing at least a portion of the actuator.

In a thirteenth aspect, alone or in combination with any of the seventh through twelfth aspects of the first embodiment, the dispenser further comprises a cover, the cover mounted on the exterior of the housing, the cover configurable in a first position wherein reciprocation of the actuator is allowed, and the cover configurable in a second position wherein reciprocation of the actuator is prevented.

In a fourteenth aspect, alone or in combination with any of the previous aspects of the first embodiment, the dispenser further comprises a packet, the packet comprising the at least one cavity containing at least one substance, the at least one cavity having a first sealed end separated from a second end coupled to an orifice. The at least one cavity can be annular and the first end separated from the second end by a gap configured to accommodate at least a portion of the wedge.

In a second embodiment, a method is provided. The method comprises providing a dispenser as described in the first, second, or third embodiments, optionally with a packet comprising at least one collapsible cavity containing at least one substance, the dispenser configured to operate in accordance with the following steps: (a) moving the actuator relative to the housing; and (b) moving of the wedge a predetermined increment cooperatively with step (a), the wedge configured for collapsing of the cavity of the packet.

In a third embodiment, a dispenser packet is provided. The dispenser packet comprising at least one annular collapsible cavity therein, the at least one cavity having a first sealed end separated from a sealable second end forming a gap in the at least one annular collapsible cavity, and at least one substance to be dispensed, where the gap is configured to receive a wedge of a dispenser for metering portions of the substance.

In a first aspect of the third embodiment, the method further comprises providing a disposable, arcuate collapsible laminate packet having a material therein and dispensing a predetermined amount of the material.

In a second aspect, alone or in combination with any of the previous aspects of the third embodiment, the at least one cavity is annular.

In a third aspect, alone or in combination with any of the previous aspects of the third embodiment, the at least one cavity comprises at least two cavities. The at least one collapsible cavity can comprise a laminate of material comprising aluminum. The at least one substance can a pharmaceutical or over-the-counter (OTC) substance suitable for treating a condition of the skin, eye, or mucus membrane.

In a fourth embodiment, a dispenser for metering a substance is provided. The dispenser comprises a housing having a longitudinal axis, the housing configured to receive a packet comprising at least one collapsible annular cavity containing at least one substance, a support member positioned in the housing, the support member having a longitudinal axis essentially parallel to the longitudinal axis of the housing, the support member rotatable within a plane substantially parallel to the longitudinal axis of the housing, a wedge coupled to the support member to rotate cooperatively with the support member, a bias element exerting a force on the wedge, the force directed substantially normal to the longitudinal axis of the housing, and a reciprocating actuator coupled to the housing and engagable with the support member. The actuator is moveable between an initial position and a first position whereby the wedge advances a single predetermined increment thereby collapsing a portion of the cavity. The actuator reciprocates in a plane substantially parallel to the longitudinal axis of the housing and cooperatively with the rotation of the support member.

In a fifth embodiment, a dispenser for metering a substance, the dispenser comprising a housing having a longitudinal axis, the housing configured to receive a packet comprising at least one collapsible annular cavity containing at least one substance, a support member positioned in the housing, the support member having a longitudinal axis essentially parallel to the longitudinal axis of the housing, a wedge rotationally coupled to the support member, the wedge rotatable in a plane substantially parallel within the longitudinal axis of the housing, a bias element exerting a force on the wedge, the force directed substantially normal to the longitudinal axis of the housing, a non-electrical stored energy source operably coupled to the wedge for rotating the wedge about the support member, and a reciprocating actuator coupled to the housing and the support member, the actuator engagable with the wedge and operable coupled to the stored energy source. The actuator is moveable between an initial position and a first position causing the wedge to advance a single predetermined increment thereby collapsing a portion of the cavity. The actuator reciprocates in a plane substantially normal to the longitudinal axis of the housing cooperatively with the rotation of the wedge.

DETAILED DESCRIPTION

Figure 1A:
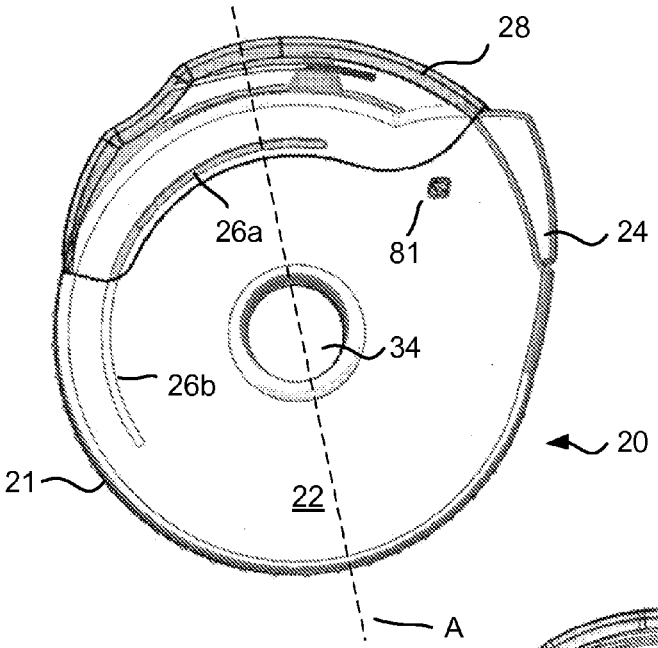
FIGS. 1A and 1B are top and bottom views, respectively, of an exemplary dispenser disclosed and described herein.

A dispenser for dispensing a substance is provided. The dispenser is configured to receive a collapsible packet containing the substance to be dispensed. In one aspect, the dispenser is configured to dispense the substance in metered amounts, for example, of substantially equal amounts. In one aspect, the dispenser maintains the packet in a relatively fixed position with the packet's longitudinal axis essentially parallel with that of the longitudinal axis of the dispenser. The dispenser provides for a force normal to the longitudinal axis of the dispenser, the force applied to a wedge to engage the packet and urge the substance out. The wedge is movable in predetermined increments controlled by the user to dispense, e.g., metered amounts, of the substance of the packet. The combination of dispenser and collapsible packet provides numerous advantages such as the ability to dispense small, accurate amounts of (viscous) substances, re-usability of the dispenser, no use of electrical/batteries or compressed gases/aerosols, and environmentally friendly manufacturability ("green").

In one aspect, the wedge of the dispenser acts on a packet comprising at least one collapsible annular cavity that can be deformed by applying a pressing or squeezing force so as to reduce the internal volume of the packet and thus to exert a pressure on the material so as to deliver it through a orifice or orifice coupled to the one end of the annular cavity. The packet can comprise multiple cavities having the same or different substances that can be dispensed together and/or mixed upon dispensing.

Embodiments of the present disclosure now will be described more fully hereinafter with reference to the accompanying drawings, in which embodiments of the disclosure are shown. This present disclosure may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. The precise shapes and sizes of the components herein described are not essential to the disclosure unless otherwise indicated. For ease of description, the dispenser of this disclosure will be described in a normal operating position and such terms as up, down, top, bottom, etc. will be used with reference to this position. It will be understood, however, that the dispenser of this disclosure may be manufactured, stored, transported, used and sold in an orientation other than the position described.

Although such terms as first, second, etc. may be used herein to describe various elements, these elements should not be limited by these terms. These terms are only used to distinguish one element from another. For example, a first element could be termed a second element, and, similarly, a second element could be termed a first element. As used herein, the phrase "and/or" includes any and all combinations of one or more of the associated listed items.

When an element is referred to as being "on" or extending "onto" another element, it can be directly on or extend directly onto the other element or intervening elements may also be present. In contrast, when an element is referred to as being "directly on" or extending "directly onto" another element, there are no intervening elements present. When an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be understood that these terms are intended to encompass different orientations of the element in addition to any orientation depicted in the figures.

Relative terms such as "below" or "above" or "upper" or "lower" or "horizontal" or "vertical" may be used herein to describe a relationship of one element to another element as illustrated in the figures. These terms are intended to encompass different orientations of the device in addition to the orientation depicted in the figures.

Relative terms such as "substantially" and "essentially" may be used herein to encompass, for example, manufacturing tolerances related to height, length, width, flatness, curvature, force, load, amount, relative orientation, etc. Such terms are used to describe an element or limitation with precision appropriate to the manufacture of such devices.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms used herein have the same meaning as commonly understood by one of ordinary skill in the art to which this invention belongs. Terms used herein should be interpreted as having a meaning that is consistent with their meaning in the context of this specification and the relevant art and will not be interpreted in an idealized or overly formal sense unless expressly so defined herein.

The term "substance," as used herein, encompasses any composition of matter or mixture that can be dispensed. For example, "substance" encompasses liquids, dispersions, solutions, suspensions, oil-in-water emulsions, water-in-oil emulsions, creams, lotions, ointments, gels, microgels, nanogels, gases, powders, and combinations thereof. In one aspect of the present disclosure, the substance is a medicament and/or pharmaceutical mixture and/or composition of matter, for example, for the treatment of skin, eye, and/or mucus membrane of a subject in need thereof. In another aspect of the present disclosure, the substance is viscous. Viscous substances include thixotropic materials, shear thinning (pseudoplastic) materials, and rheopectic materials. Exemplary substances can include pharmaceuticals such as Altabax, Altargo, Bactroban, Betnovate, Eumovate, Trimovate, and Zovirax, cosmeceuticals such as Abreva, Biotene, and Eumovate. Consumer Goods that can be used in the dispenser include, for example, Aqua Fresh, Polident, Hinds, Iodex, Lactacyd, Macleans, Paradontax, and Sensodyne, specialty items such as Eletté brands (Stiefel Corp.), e.g., Creamy Wash, Exfoliating Solution, Zone Treatment; and REVALÉSKIN® brands, e.g., Facial Cleanser, Day Cream with SPF 15 Sunscreen, Night Cream, Intense Recovery Treatment, and Replenishing Eye Therapy.

Numerous other advantages and features of the dispenser as disclosed herein will become readily apparent from the claims, drawings and the detailed description of the disclosure.

Figure 1B:
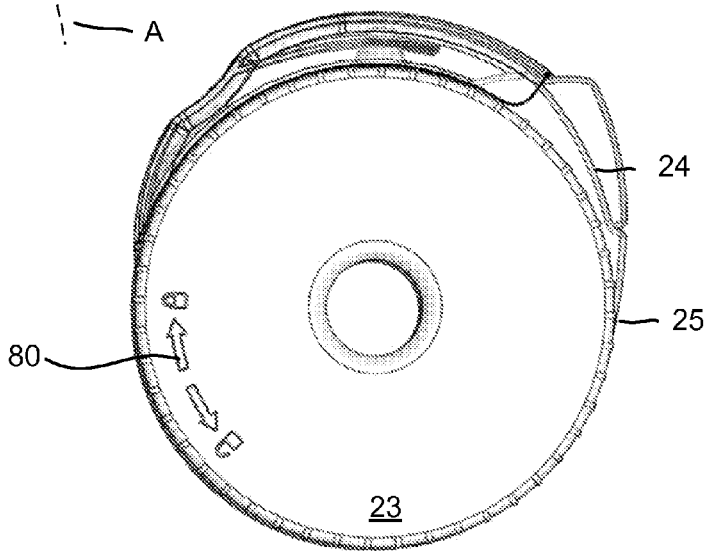

Thus, referring now to FIG. 1A and FIG. 1B, opposing side views of an exemplary dispenser 20 are shown. In certain aspects, dispenser 20, having a longitudinal axis A is separable into halves comprises first housing portion 22 and second housing portion 23, which can secure together via coupling means described below to form housing 21. Dispenser 20 is shown with movable cover 28, which selectively opens and closes the orifice of a collapsible packet that extends through an opening in housing 21, as will be discussed.

Cover 28 partially straddles first housing portion 22, cover 28 being slidably received in track 26*a* of first housing portion 22.

Dispenser 20 as shown is generally annular in shape but may be of any geometric shape, such as oval, triangular, rectangular, square or other polygon shape. Seat 25 receives actuator 24. Actuator 24 protrudes from housing in a plane substantially parallel to axis A, actuator 24 being secured to housing 21 via seat 25.

Figure 2:
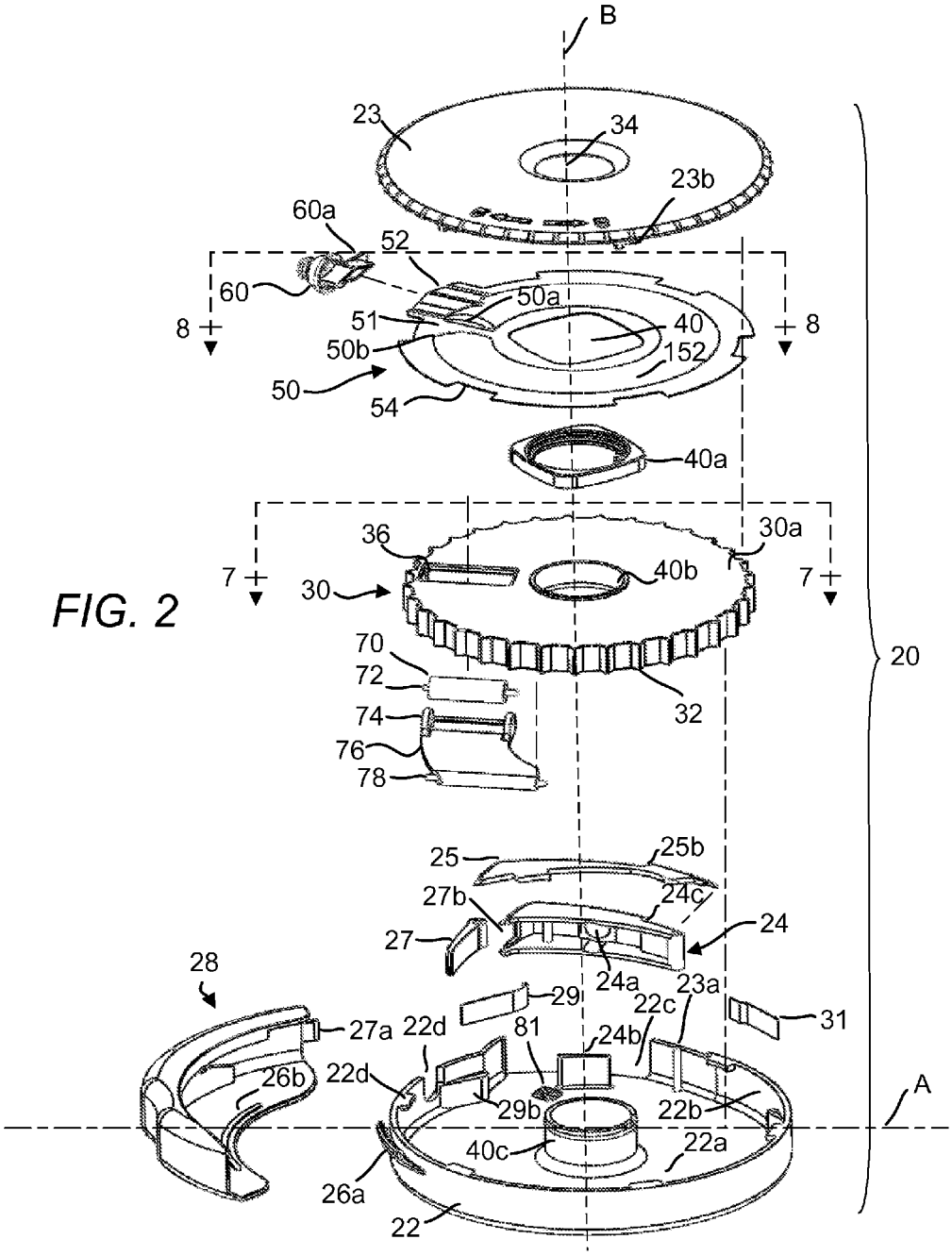
FIG. 2 is an exploded view of the exemplary dispenser of FIGS. 1A and 1B.

FIG. 2 is an exploded view of dispenser 20. Housing portion 23 is shown with longitudinal axis A, perpendicular to axis B, having a bottom surface 22*a* terminating in wall 22*b* around its perimeter. Wall 22*b* has opening 22*c* for receiving actuator 24 and allowing actuator to reciprocate in its seat or slot relative to housing 21, e.g., in a plane including axis A. In other embodiments, actuator 24 can be positioned on a surface or edge of housing 21 and can be configured to slide along the surface or edge thereof in a plane essentially parallel to the longitudinal axis of the housing. Surface 22*a* of housing portion 22 has threaded projection 40*c* for receiving support member 30 and threaded retaining element 40*a* to secure support member 30 while allowing for rotation of the support member 30 about projection 40*c*. Retaining element 40*a* is shown as square, but can be any polygonal shape. Cutout 22*d* receives orifice 60 of collapsible packet 50.

Support member 30 is movable in a plane that is substantially parallel to the longitudinal axis A. Support member 30 can comprise centered opening 40*b* for receiving threaded projection 40*c* of housing portion 22. Threaded retaining element 40*a* can be configured to receive opening 40 of packet 50 for positioning by user and to prevent rotation of packet 50 relative to support member 30. In the exemplary embodiment shown in FIG. 1, opening 36 is provided adjacent to centered opening 40*b*. Opening 36 is positioned so as to correspond to collapsible cavity(s) of packet 50. Opening 36 can be sized to receive at least a portion of wedge 70 and to provide for reciprocation of wedge substantially normal to the longitudinal axis A of housing 21. In the embodiment shown, wedge 70 is biased by lever 76. Lever 76 receives wedge 70 via pins 72 at end 74, and a second end 78 secures to support member 30. Lever 76 is biased in proximity to end 74 by bias elements (described below) to exert a force substantially normal to the longitudinal axis A of housing 21, the force sufficient to cause wedge 70 to collapse cavity of packet 50, as further described below. As shown, support member 30 is configured as a gear ring with teeth 32 about is perimeter, the teeth oriented essentially normal to the longitudinal axis A. Other gear teeth arrangements on the support member 30 can be used, for example, on surface 30*a*. Support member 30 is shown as a gear ring, but can be of various shapes provided that it is movable about a plane that is substantially parallel to the longitudinal axis A and couples to wedge 70 that exerts a force that is substantially normal to the longitudinal axis A. In other embodiments, wedge 70 can be a raised portion on surface 30*a* of support member 30, with biasing elements positioned under support member 30 and providing a force on the support member 30 (e.g., spring) positioned about threaded projection 40*c*. Wedge 70 can also be mounted on surface 30*a* with biasing elements positioned directly underneath wedge.

Housing can comprises opening 34 sized to allow a human finger to freely enter. Indicia 80 shows, for example, a locked and open configuration. Window 81 provides, for example, the viewing of the number of doses dispensed, which can correspond to the amount of material present or remaining in the dispenser.

Cover 28 provides for selective positioning where orifice 60 of packet 50 is received by sealing element 142 for reversibly sealing the contents of packet 50 and preventing the contents thereof from drying out or otherwise degrading. Cover 28 as shown, straddles housing 21, and track 26*a* cooperatively engages grove 26*a* of housing portion 22 via track preventing over travel. Audible or tactile sensations can be provided to the user for indicating proper sealing of the cover, and sealing element 142 over orifice 60. Cover 28 includes tongue 27*a* which is received by actuator opening 27*b* when cover is positioned in a closed configuration, tongue 27*a* interferes with the reciprocation of actuator 24 and prevents it from activating unintentionally. Other configurations can be employed for moving cover 28 about the housing 21 and for preventing accidental dispensing, as are known in the art.

In dispenser 20 as shown in FIG. 2, the housing is configured with two housing portions, a first housing portion 22 that acts as a stationary frame, and a second housing portion 23 with locking features spaced around axis B, e.g., tabs, that interact with corresponding slots on the first housing portion. Housing portion 23 is releasably securable to housing portion 22, for example, via corresponding engagement members 23*b*, 22*d*, respectively.

As shown in FIG. 2, first housing portion 22 has a smaller set (22*d*) of spaced pairs of tabs that engage a corresponding larger set (23*b*) on the second housing portion 23 for locking. Thus, when the first housing portion 22 is aligned with the second housing portion 23, the halves correctly align and can be locked by twisting clockwise, which engages the larger set of tabs 23*b* with retention features 22*d* in the second housing portion 23. Twisting the second housing portion 23 counterclockwise disengages the tabs from the retention features so the first housing portion can be separated and removed. Other configurations, including clam shell and sliding designs can be used.

Still referring to FIG. 2, actuator 24 at end adjacent lip 24*c* is pivotally secured in wall member 23*a* of housing portion 22, and is otherwise free to reciprocate in and out of seat 25 in a plane essentially parallel to the longitudinal axis A of housing 21, biased outward by a spring (not shown) held at one end in seat element 24*a* and at the other by element 24*b*. Actuator 24 is restrained in its outward travel by lip 24*c* of actuator 24 that interferes with lip 25*b* on seat 25. In other embodiments, the actuator can be positioned on a surface of the housing.

Pawl 27 is pivotably connected to actuator 24 at its opposite end. Pawl 27 free end is engages one of gear teeth 32 of support member 30. Pawl 27 is biased against gear teeth 32 by bias element 29, (e.g. arm spring) which is secured by housing element 29*b*. Actuator 24 is configured so as to provide a first state (or configuration) at rest, and a second state or configuration wherein the actuator is depressed towards housing portion 22 by a user, causing pawl 27 to drive support member 30 an incremental distance in a first direction in a plane substantially parallel to the longitudinal axis A of housing 21. In the exemplary dispenser shown in FIG. 2, pawl 27 engages teeth 32 of support member 30 and causes rotation of support member 30. Other configurations of pawl and teeth can be provided, and motion of the support member can be linear as well as rotational.

Actuator 24 is biased against housing portion 22 by spring (not shown) positioned between element 24*b* of housing portion 22 and seat element 24*a* of actuator 24, causing actuator 24 to return to the first state after incremental movement of the support member 30 is complete. In one aspect, incremental movement of support member 30 is provided as pawl 27 drives the support member and then falls between the moving gear teeth. During transition from the actuator's first state to the second state, the support member 30, together with wedge 70, moves away from closed end 50*b* of packet 50 towards open end 50*a*, collapsing a portion thereof, urging the contents of packet towards outlet 52. To prevent reverse movement of support member 30 and wedge 70 during or immediately after activation, stop 31 sized to the spacing between gear teeth 32 and secured to housing portion 22 can be used. Stop 31 cooperates with the driving of the support member 30 by pawl 27, falling between the teeth as the support member moves. In one aspect, stop 31 is configured to allow a predetermined amount of reverse movement so as to reduce or eliminate "drooling" of the device. Drooling is where substance in packet 50 continues to exit the dispenser after the actuator is returned to the first state, which is undesirable. Gear teeth, pawl length, arm spring, stop, and diameter of gear can be sized and configured so as to dispense a predetermined amount of the contents of the collapsible packet so as to provide a predetermined amount upon activation of the dispenser and, in addition, to reduce or eliminate drooling. For example, a 30 day supply of material can be dispensed using an appropriately sized diameter gear with 33 gear teeth. Other dimensions of diameter and number of gear teeth can be used to match the amount of material in the packet with the expected number of doses. Audible and/or tactile indications to the user to indicate successful operation of the device upon depressing the actuator and transitioning from the first state to the second state and then returning back to the first state can be provided, for example, by using an audial "click-click" created by the gear spring. Other tactile and audile indications to the user can be employed.

Cover 28 is positioned on the perimeter of housing portion 22 and comprises groove 26*b* for slidably receiving track 26*a* of housing portion 22. Tongue 27*a* of cover 28 is received by actuator opening 27*b* when cover is positioned in a closed configuration to prevent the actuator from driving the pawl. Cover 28 can further comprise additional elements for engaging orifice 60 or outlet 52 to reversibly seal the packet and prevent and/or protect the material from drying out or oxidation, or protect the orifice from contamination.

The actual elements, including without limitation, gear teeth, pawl, arm spring, gear spring, actuator, actuator housing, wedge, lever member, cover, and housing portions are exemplified the drawings, and can be configured and arranged in other shapes or substituted with functionally equivalent components, so long as the dispenser provides for metering of a substance as herein disclosed.

Figure 3:
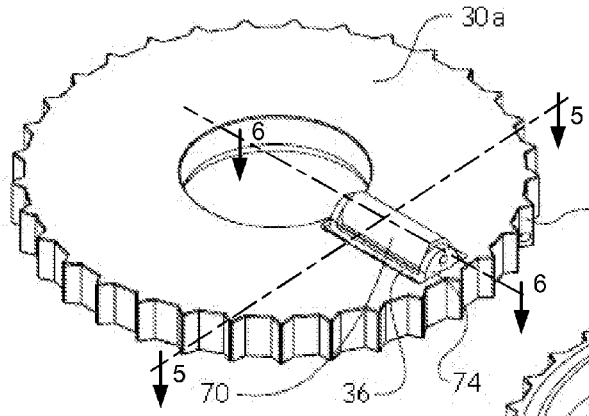
FIG. 3 is a perspective top view of a support member of the exemplary dispenser of FIG. 2.
Figure 4:
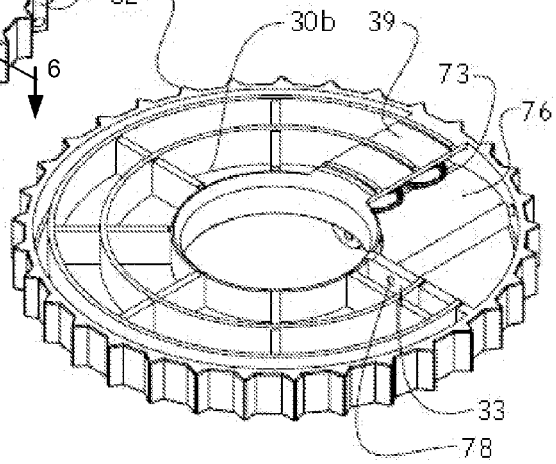
FIG. 4 is a bottom view of FIG. 3.

FIGS. 3 and 4 depict top and bottom views of support member 30 of FIG. 2. Support member 30 is shown as annular but can be of other geometric shape so long as it can move within housing 21 and support wedge 70 and bias element 71. Top surface 30*a* of support member 30, which receives packet 50, with opening 36 providing for a portion of wedge 70 to project through surface 30*a* of support member. Wedge 70 is shown as a roller, which can be stationary or rotatable about its longitudinal axis. Other shapes of wedge can be used, such as an edge, blade, sweep, etc. In the configuration shown in FIGS. 3 and 4, wedge 70 exerts a force substantially normal to surface 30*a* (and longitudinal axis of housing 21) to uniformly compress and collapse cavity(s) of packet 50. FIG. 4 presents a bottom perspective view of support member 30, showing bottom surface 30*b* and rib elements 33, 39 for receiving and securing lever 76. Lever 76 is coupled to element 33, preferably so that lever 76 is essentially parallel to the longitudinal axis of wedge 70. In other configurations, wedge 70 can be positioned in element 39 and directly coupled to bias element 71 coupled to seats 73 without a lever.

Figure 5:
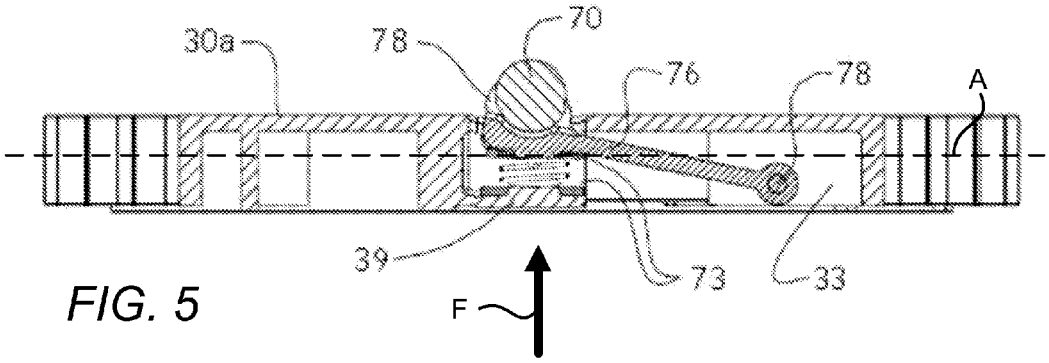
FIG. 5 is a section side view taken along line 5-5 of FIG. 3.
Figure 6:
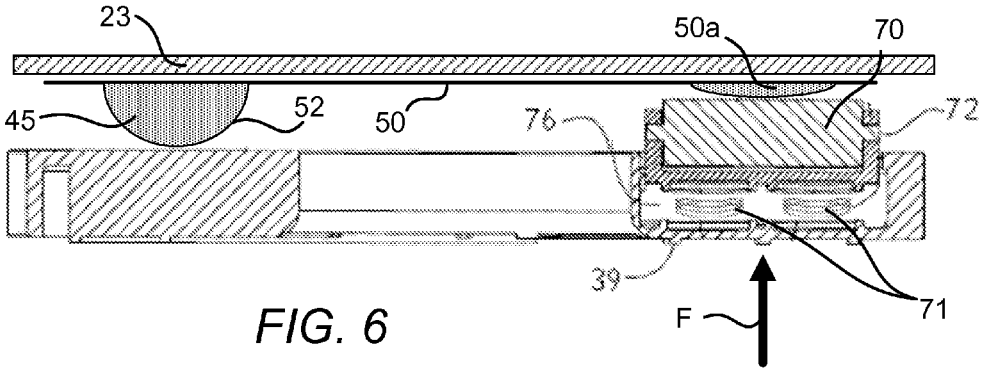
FIG. 6 is a section side view taken along line 6-6 of FIG. 3.

FIGS. 5 and 6 are sectional views taken along lines 5-5 and 6-6 of FIG. 3, respectively, showing lever 76 and wedge 70 arrangement. Seats 73 of lever 76 together with housing element 39 receive and secure bias element 71. Bias element 71 can be springs, living hinges, or resiliently compressible material. Seat 73 of lever 76 is distally positioned from end 78 and housing portion element 33. Biasing member provide force (F) substantially normal to the longitudinal axis A of housing 21 to at least a portion of wedge 70 projecting wedge 70 from top surface 30*a* of support member 30 so as to contact and collapse portion 50*a* of collapsible cavity 152 of packet 50 between housing portion 23 and wedge 70.

Figure 7:
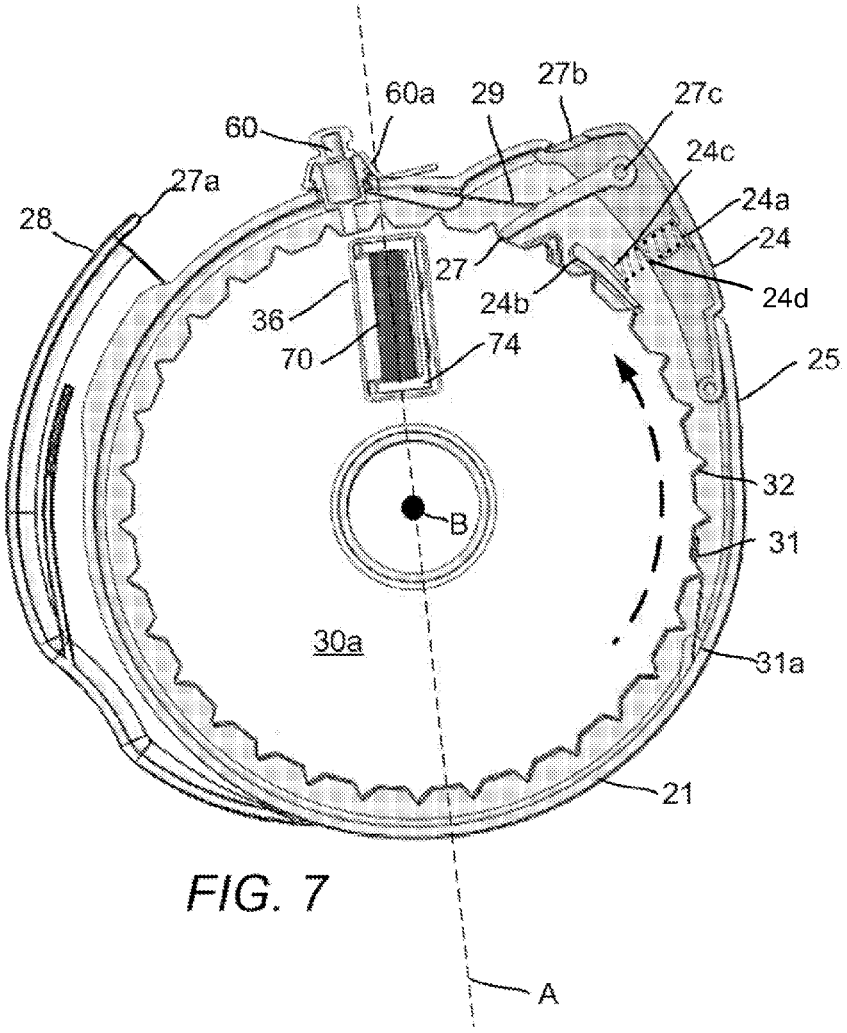
FIG. 7 is a top view of the dispensing mechanism of an exemplary dispenser viewed along line 7-7 of FIG. 2, disclosed and described herein.

FIG. 7 presents a partial top sectional view along line 7-7 of FIG. 2 of dispenser 20. Cover 28 is shown in an open configuration with tongue 27*a* removed from actuator opening 27*b*. Actuator 24 is shown configured in a first state (at rest), biased against housing portion 22 via bias element 24*d* coupled to seat elements 24*a* and 24*c* (seat 24*c* mounted on housing element 24*b*).

Figure 8:
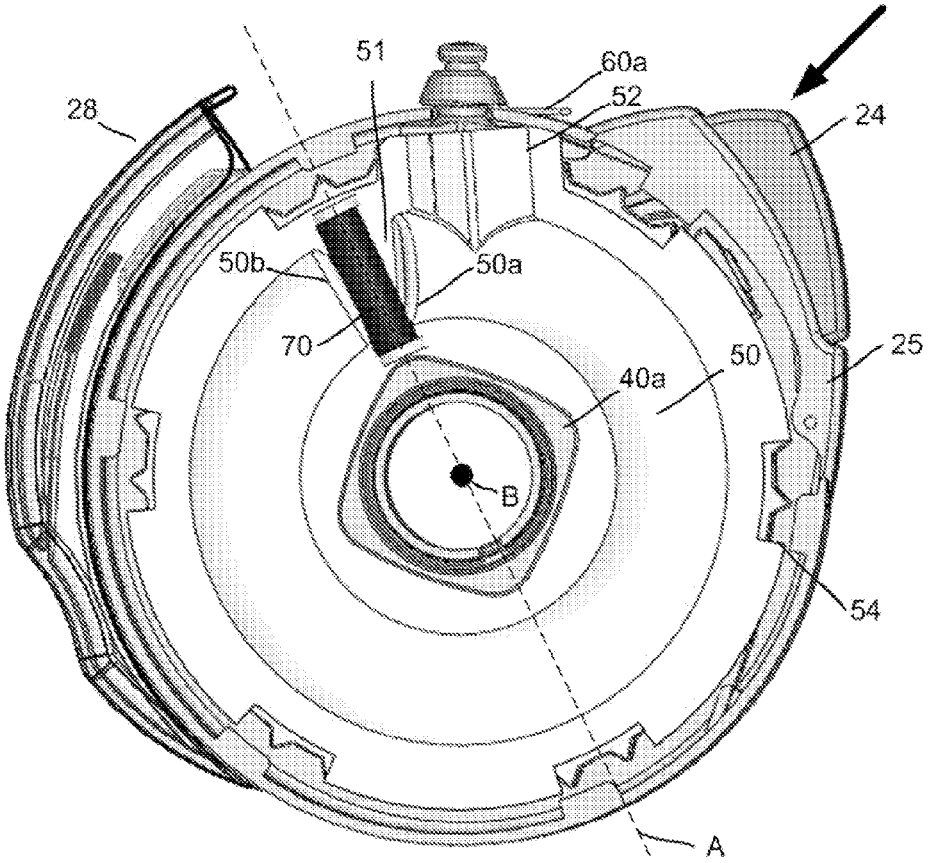
FIG. 8 is a top view of an exemplary dispenser viewed along line 8-8 of FIG. 2, showing a packet positioned for first use, as disclosed and described herein.

FIG. 8 presents a partial top sectional view along line 8-8 of FIG. 2 of dispenser 20. Actuator is shown intermediate or just prior to the transition between first state and second state (solid arrow). In this transition from first to second state, pawl 27 engages teeth 32 of support member 30 and causes incremental movement of support member 30 as the pawl drives support member as shown by dashed arrow. Support member 30, together with biased wedge 70 and lever 76, rotate away from closed second end 50*b* of packet 50, collapsing a portion thereof, urging the contents of packet 50 towards outlet 52. The actuator returns to the first state as it is biased against housing portion 22 by spring (not shown) positioned between element 24*b* of housing portion 22 and seat element 24*a* of actuator 24. Reverse movement of support member 30 is prevented during transition from the second state back to the first state by stop 31, secured to housing portion 22, which falls between teeth as support member rotates. In one aspect, stop 31 is configured to allow a predetermined amount of reverse movement to reduce or eliminate "drooling" of the device, as discussed above. Packet 50 is held stationary relative to movement of support member 30 via engaging elements 54 and/or threaded retaining element 40*a*.

To use dispenser 20, a user would slide cover 28 back and separate the corresponding housing portions 22, 23 of the dispenser by twisting in opposite directions. Packet 50 would be positioned on housing portion 22 such that gap 51 in packet is positioned over wedge 70 and orifice/outlet is aligned with the corresponding housing portion 22*d*, as depicted in FIG. 8. Support member 30 is freely rotatable in one direction to allow the positioning of the opening 36 and wedge 70 with the packet gap 51. Once aligned, the dispenser housing portions 22, 23 would then be closed by rotating one housing portion so as to engage corresponding engagements on the other housing portion. Orifice cover 60*a*, if present, would be removed. With reference to FIGS. 6, 7, and 8, activation of dispenser 20 for metering dosages is achieved by applying a force to actuator 24 (with finger), causes pawl 27 to engage teeth 32 of support member 30 and rotate support member in an counter-clockwise direction (as shown by dashed arrow of FIG. 7), wedge 70 compresses packet portion 50*a* as it rotates around housing 21, urging the substance towards orifice 60. When user releases force to actuator 24, it reciprocates back to its initial position, bias 29 causes pawl 27 to engage the next teeth in sequence of support member 30. After dispensing, cover 28 can be slid over orifice for sealing the packet. Priming of the device may be necessary to remove air trapped in outlet 52 and orifice 60.

In a second embodiment, an alternate dispenser configuration is provided, where the principle of operation is essentially the same as described above, e.g., a wedge applying a force substantially normal to the longitudinal axis of the dispenser with movement of the wedge in a plane substantially parallel to the longitudinal axis of the dispenser. At least one difference in the second embodiment dispenser is that the reciprocation of the actuator is normal to the longitudinal axis of the dispenser. Other differences include the use of a stored energy source coupled to the actuator to drive the movement of the wedge. In this alternate configuration, the support member is stationary relative to the packet, the actuator reciprocating relative to the support member, the wedge driven about stationary support member. Metered dispensing of a substance from a packet having a collapsible cavity(s) is provided.

Figure 9A:
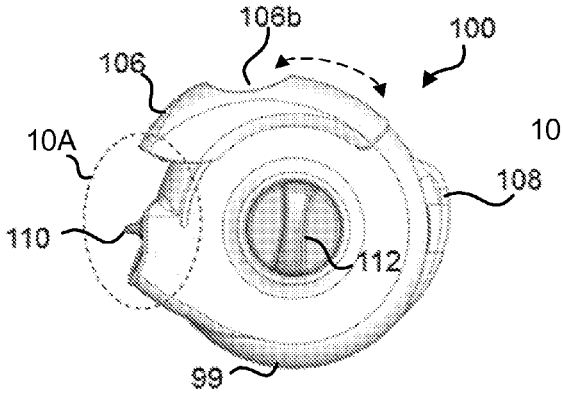
FIGS. 9A and 9B are top views of an second exemplary dispenser disclosed and described herein shown in a use configuration and a stored configuration, respectively.
Figure 9B:
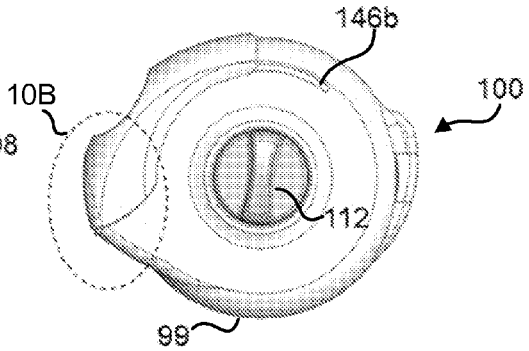
Figure 10A:
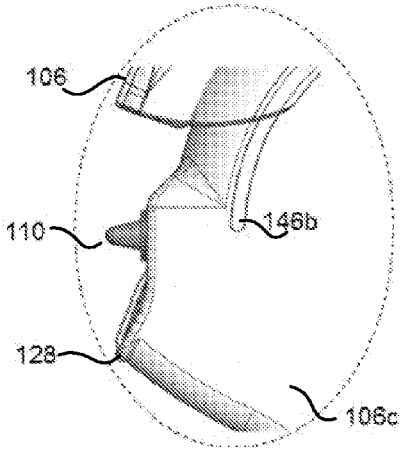
FIGS. 10A and 10B are partial views of the dispensing orifice of the exemplary dispenser of FIGS. 1A and 1B, respectively.
Figure 10B:
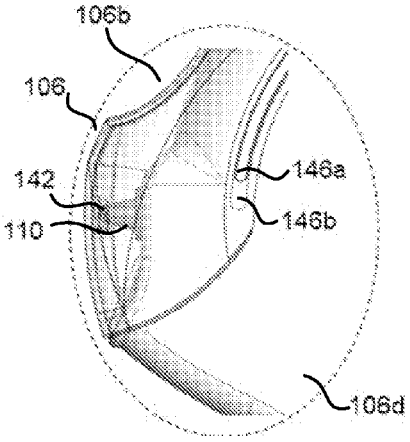

Thus, referring now to FIGS. 9A and 9B, an exemplary dispenser 100 presents a housing 99. Winder 112 projects from a central opening in housing 99, winder coupled to a stored energy source as further described below. In certain aspects, the dispenser is separable into halves, which can hingebly rotate about hinge 108. Selectively positionable cover 106 with grove 146*a*, similar to that described above for the first embodiment, moves about housing 99 along track 146*b*, and has finger-rest 106*b*. As described above, FIGS. 10A and 10B depict cover 106 in an open and closed configuration, respectively, with sealing element 142 reversibly engaging orifice 110 for sealing the contents of the dispenser and preventing the substance from drying out or otherwise degrading. Cover 106 is prevented from over travel by stop 128. Audible or tactile sensations can be provided to the user for indicating proper sealing of the cover, and sealing element 142 over orifice 110. Other configurations for moving the cover about housing 99, as are known in the art, can be employed.

Figure 11A:
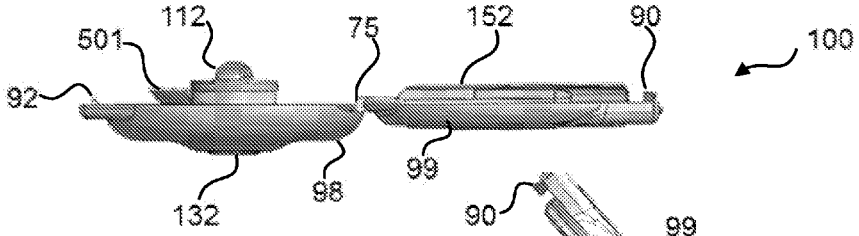
FIGS. 11A, 11B, and 11C are side views of a fully open configuration, a partially open configuration, and a closed configuration, respectively, of the exemplary dispenser of FIG. 9A.
Figure 11B:
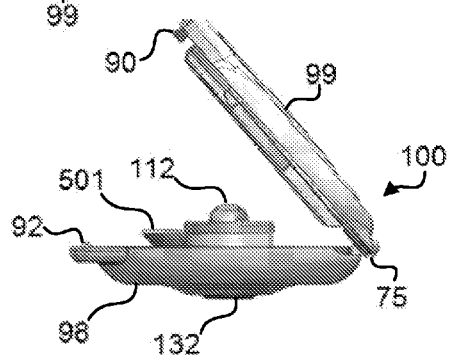
Figure 11C:
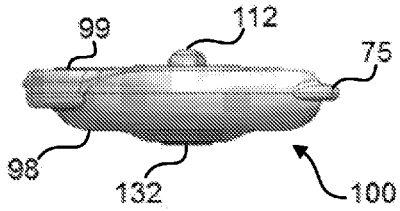

FIGS. 11A thru 11C presents dispenser 100 where the housing is comprised of an first housing portion 99*a* and second housing portion 99*b*, hingably connected by hinge 75, e.g., in a clam-shell arrangement. Portions 99*a*, 99*b* are securable by corresponding coupling elements 92 and 90, respectively. First housing portion provides opening for a portion of actuator 130 (e.g., a button) while second housing portion provides opening for winder 112. Wedge 501, show as a blade, cooperably engages packet 50 as discussed further below.

Figure 11D:
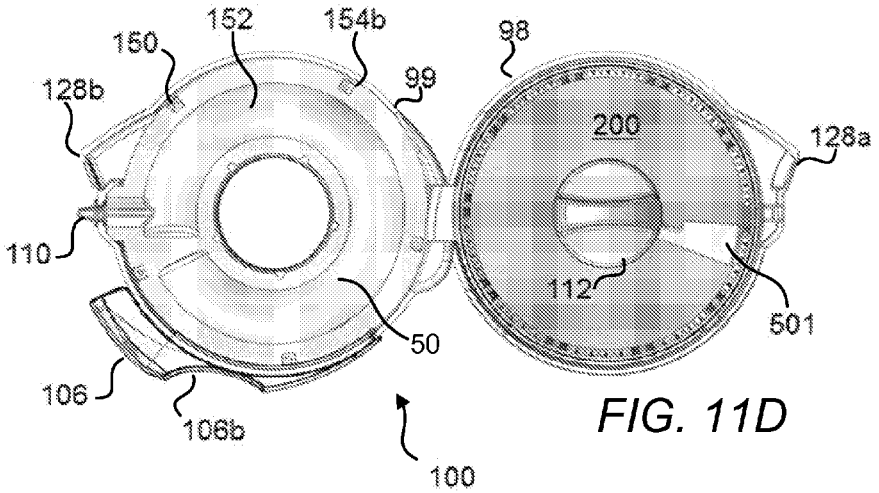
FIG. 11D is a top view of FIG. 11A.

FIG. 11D is a top view of the embodiment depicted in 11A showing packet 50 having collapsible cavity 152 of packet 50 comprising a substance (not shown). Packet 50 can include alignment elements 154*b* to properly position the packet in the housing and to properly position the packet with the wedge 501. Wedge 501 is supported on stationary support member 200. Wedge 501 is coupled to a stored energy means operably coupled to winder 112 and actuator 130 (discussed further below).

Figure 12A:
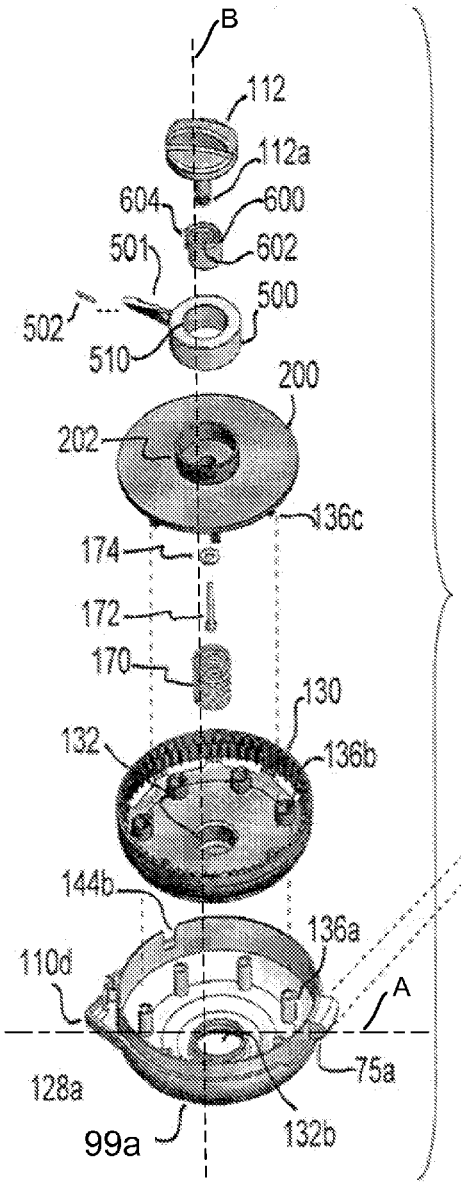
FIGS. 12A and 12B are exploded views of the exemplary dispenser of FIG. 11D.
Figure 12B:
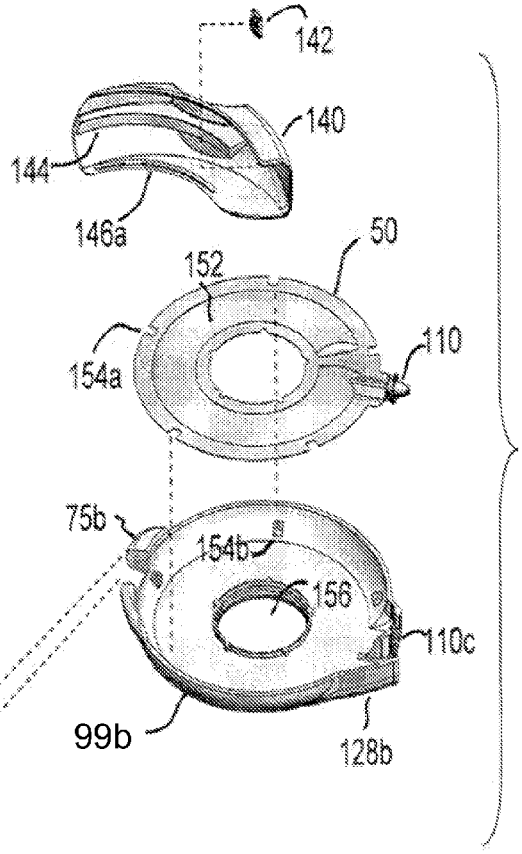

FIGS. 12A and 12B are exploded views of exemplary dispenser 100. Dispenser 100 is shown in a clam-shell configuration having lower housing portion 99*a* having longitudinal axis A with surface having an annular wall projecting therefrom, the surface having a plurality of hollow projections 136*a* and a central opening 132*b*. Actuator 130 has surface having an annular wall projecting therefrom, the surface having a plurality of hollow projections 136*b* projecting from the surface, projections 136*b* sized and aligned to receive projections 136*a* of housing portion 99*a*. Actuator 130 has centrally positioned cup 132 sized to project from opening 132*b* of lower housing portion 99*a*. Support member 200 has projections 136*c* projecting from surface, projections 136*c* sized and aligned with projections 136*b* and 136*a*. Thus, support member 200, actuator 130 and lower housing portion 99*a* are stationary relative to each other in the plane parallel to the longitudinal axis of housing 99. Bias element 170 is positioned between actuator 130 and support member 200. Bias element 170 is received in cup 132 and allows actuator 130 to reciprocate along projections 136*a* in an "in and out" manner substantially normal to the longitudinal axis of housing 99 for metered dispensing as further discussed below. Bias element 170 also provides a force to support member 200 substantially normal to the longitudinal axis of housing 99.

Support member 200 includes receiving element 202, shown as an annular collar. Wedge 501 is coupled to annular collar 500 sized to be received by receiving element 202 of support member 200. Annular collar 500 rotates wedge 501 about support member 200 in a plane substantially parallel to the longitudinal axis of housing 99 while receiving a force substantially normal to the longitudinal axis of housing 99 from bias element 170.

Winder 112 has post having threading elements 112*a* projecting through annular collar 500 and support member 200, secured by nut/washer 174 and to lower housing portion 99*a* via screw 172. Winder 112 is operably engaged to stored energy source 600 coupled with winder 112 first position 602, and with engagement element 510 of annular collar 500 at its second position 604. Stored energy source 600 can comprise a torsion spring or clock spring, for example. Other sources of stored energy sources can be used. Winder 112 can include a stop to prevent over winding of the stored energy source 600. Choice of stored energy source, length and width of wedge can be determined taking into account the dimensions of packet and viscosity of the material to be dispensed, which is within the skill of one in art. For example, packet can be tapered towards the orifice to facilitate dispensing. Thus, in this configuration, wedge 501 moves from a first position relative to the support member 200 to a second position along the support member corresponding to the reciprocation of the actuator as further discussed below. Annular collar 500 includes wedge 501, which can include pin 502 or other projection along the longitudinal axis of wedge 501.

The dispensing mechanism is supported on support member 200 via corresponding collar 202 which receives annular collar 500 and is secured to support member 200 by fastening elements, shown as screw 172 and nut/washer 174.

In other words, actuator 130 is configured to move in a second direction (along horizontal axis B) different from the first direction of wedge 501. In one aspect, inner perimeter of actuator 130 at least partially surrounds outer perimeter of support member 200. As shown, all of the outer perimeter of support member 200 is surrounded by actuator 130.

Hingably connected to first housing portion 99*a* is second housing portion 99*b* via cooperating hinges 75*a*, 75*b*, respectively, securing together with corresponding securing elements 128*a*, 128*b*, respectively. Second housing portion 99*b* receives packet 50 with collapsible cavity(s) 152 and can include cooperating alignment elements 154*b*, 154*a*, respectively. Openings 110*d* and 110*c* of lower housing portion 99*a* and of upper housing portion 99*b*, respectively, receives orifice 110 of packet 50. Second housing portion 99*b* includes opening 156 for exposing winder 112. Packet 50 can include corresponding opening to at least partially surround opening 156 of upper housing portion 99*b*.

Cover 140 includes projection 144 that prevents the reciprocal movement of actuator 130 by blocking the travel of actuator so as to prevent accidental activation. Thus, projection 144 of cover in a closed configuration, interferes with feature 144*a* (FIG. 13*a*) of actuator, preventing movement of feature 144*a* in cut-out 144*b* of first housing portion.

Sealing element 142 is positioned in cover 140 to sealably engage orifice 110 to prevent the contents of packet 152 from drying out or degrading.

Figure 13A:
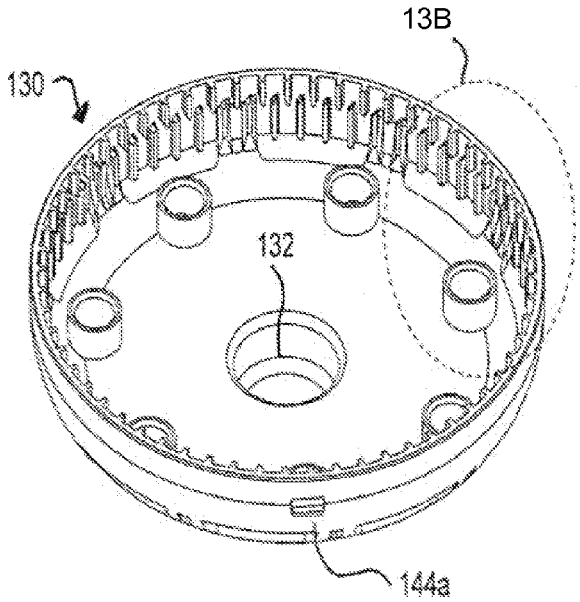
FIGS. 13A and 13B depict an actuator of the dispenser of FIG. 12A and a partial view of the actuator, as disclosed and described herein.
Figure 13B:
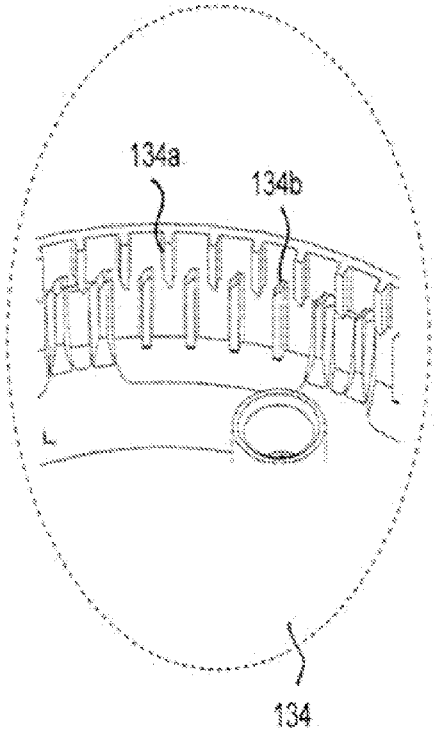
Figure 14:
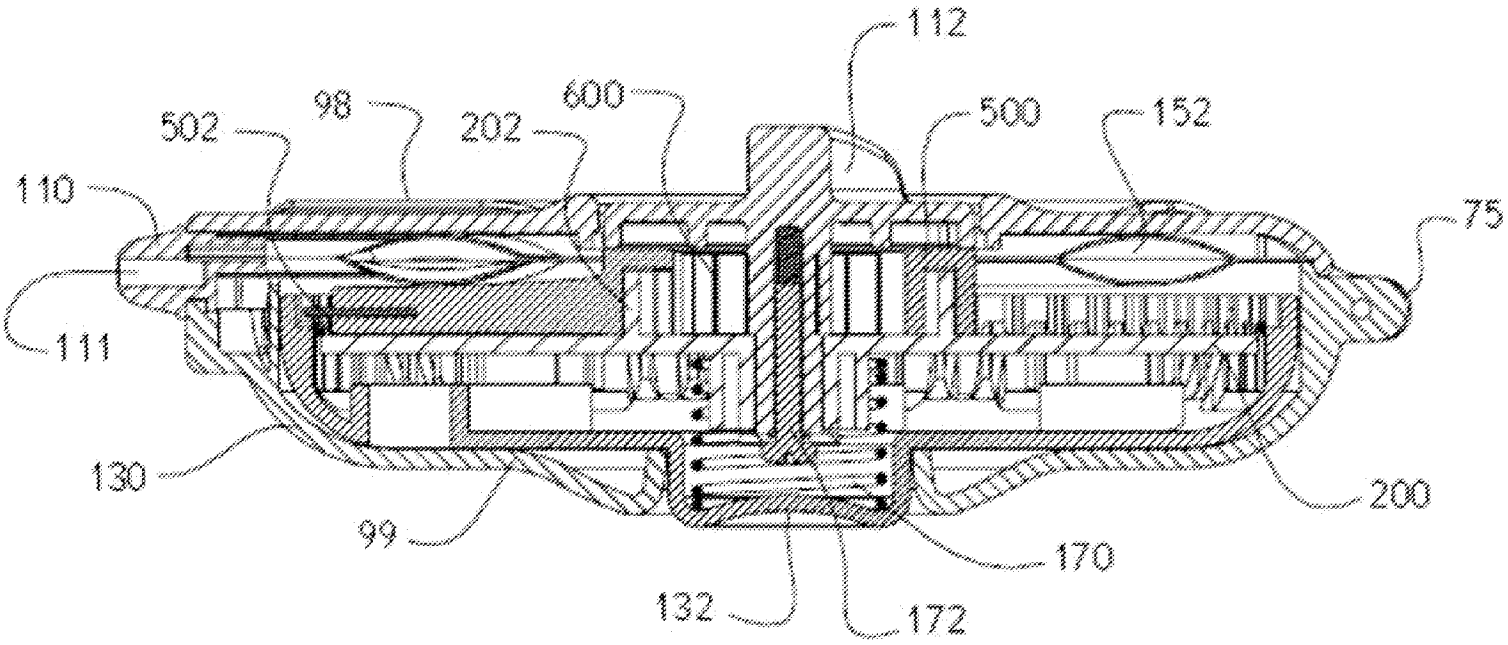
FIG. 14 is a sectional side view of the dispenser of FIG. 9A.
Figure 15A:
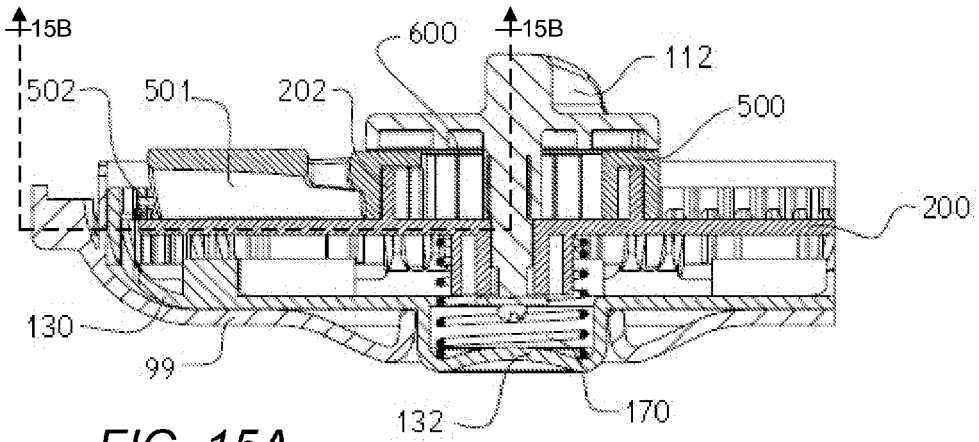
FIG. 15A is a partial view of the dispenser of FIG. 14 shown in an un-activated state.
Figure 15B:
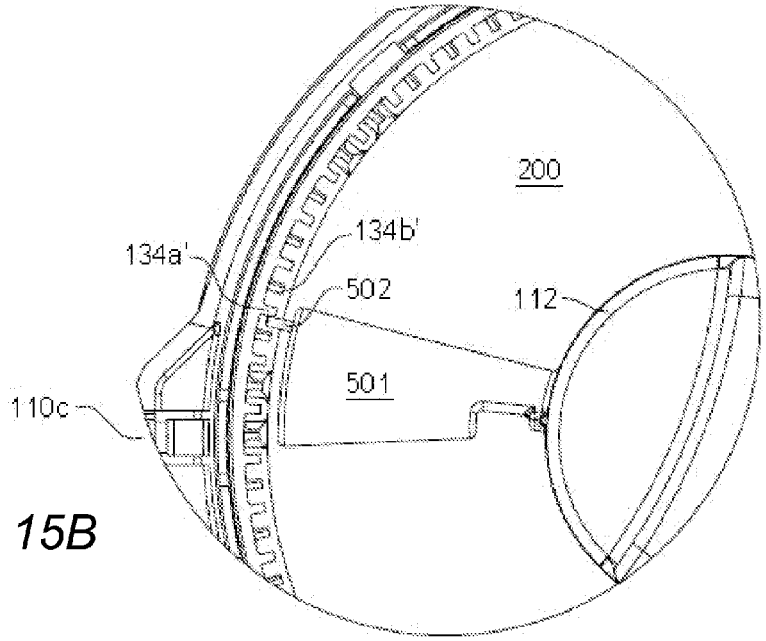
FIG. 15B is a partial top view of the dispenser of FIG. 15A taken along line 15B-15B of FIG. 15A.
Figure 16A:
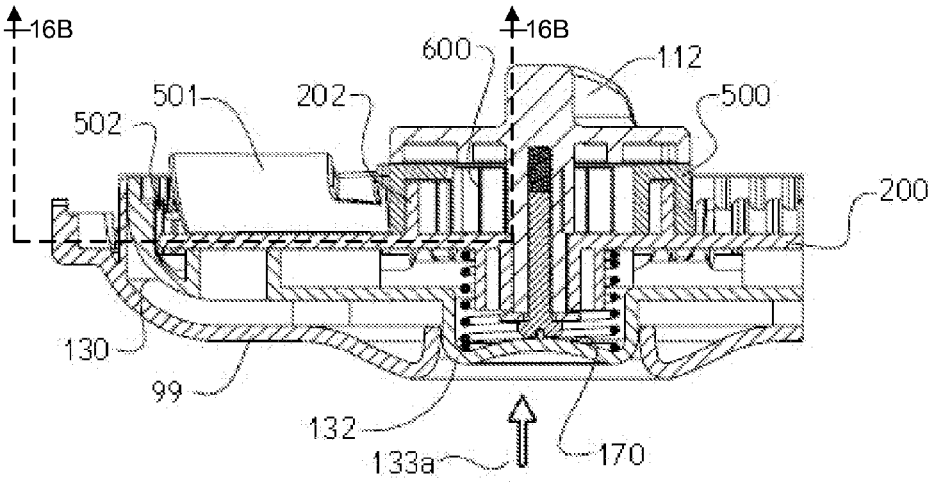
FIG. 16A is a partial view of the dispenser of FIG. 14 shown in the first stage of an activated state.
Figure 16B:
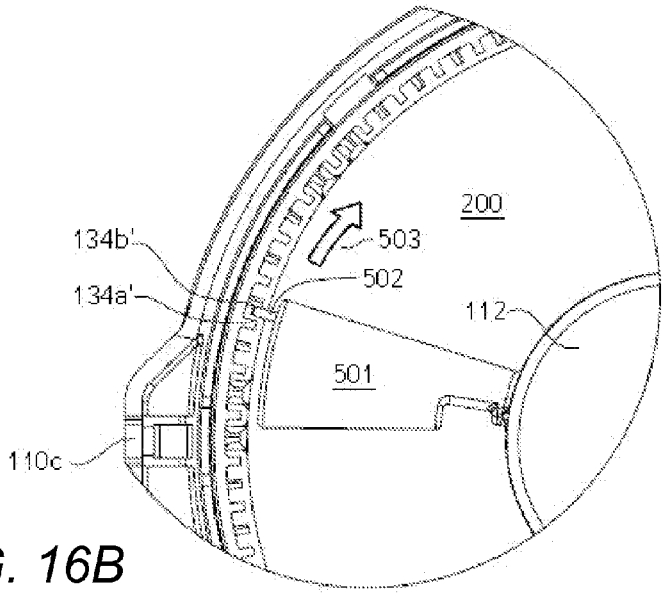
FIG. 16B is a partial top view of the dispenser of FIG. 16A taken along line 16B-16B of FIG. 16A.

FIGS. 13A and 13B are more detail of actuator 130 and inner perimeter which at least partially surrounds support member 200 and comprises a plurality of stops 134*a*, 134*b*, which engage pin 502 of wedge 501. As shown in detail 134 of FIG. 13B, the inner perimeter of actuator 130 comprises at least one first stop 134*a* configured for engaging the wedge pin 502. Second stops 134*b* are also employed about the inner perimeter of actuator 130 for interaction with the wedge pin 502. In a preferred aspect, the plurality of first stops 134*a* are interdigitally positioned with respect to the plurality of second stops 134*b*. The interdigitally positioned stops can be equally spaced apart a predetermined first distance to provide for a predetermined fixed movement distance for the wedge, and thus, meter dispensing of the contents of the packet. Other configurations of the first and second stops are envisaged. For example, if the packet is tapered towards the orifice, the distance of the stops can be adjusted about the perimeter to maintain a constant dispensed amount. The distance between each of the stops (first or second) can be varied about the perimeter of actuator 130.

Figure 17A:
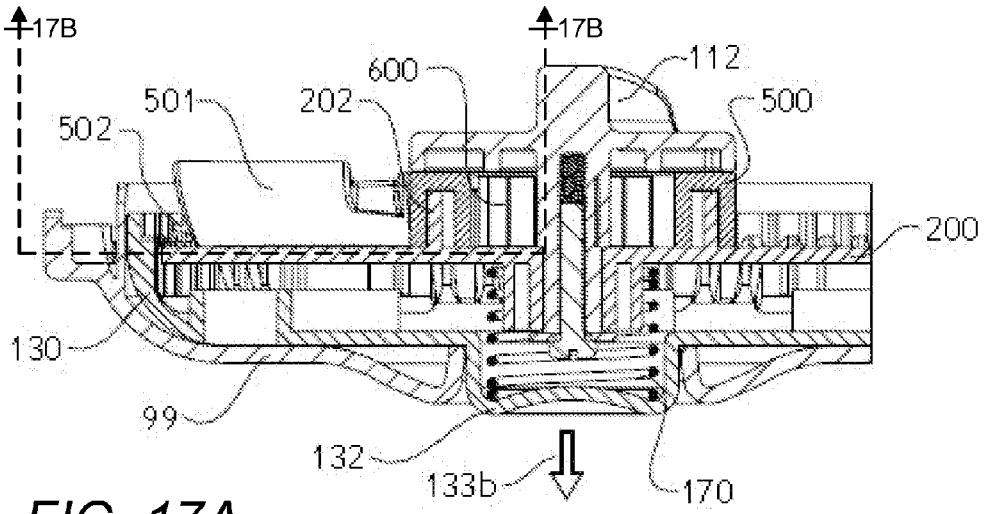
FIG. 17A is a partial view of the dispenser of FIG. 14 shown in the second stage of an activated state.
Figure 17B:
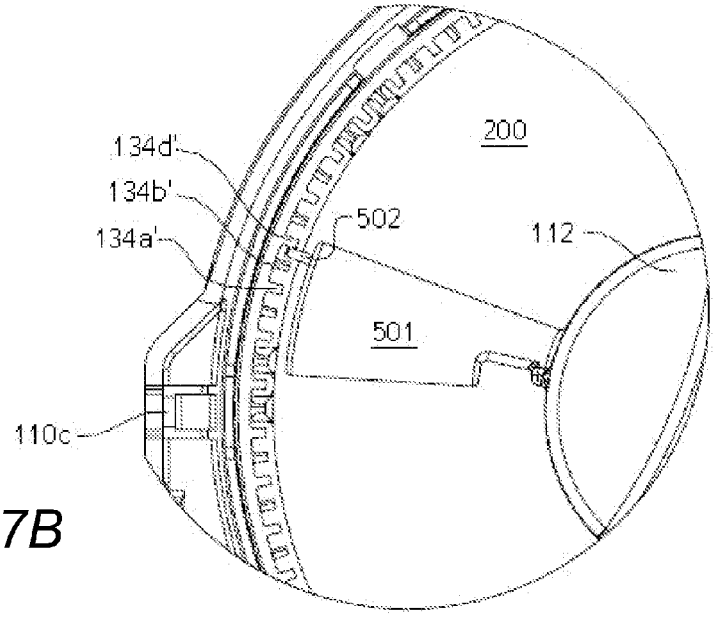
FIG. 17B is a partial top view of the dispensing mechanism of the exemplary dispenser of FIG. 11A taken along line 17B-17B of FIG. 17A.

Referring now to FIGS. 14, and 15A thru 17B, the dispensing mechanism of dispenser 100 using actuator 130 and wedge 501 is shown. At first use, dispenser 100 receives packet 50 (first stage, FIGS. 15A & 15B), with wedge pin 502 is held at rest against one of the plurality of first stops (134*a*') and wedge 501 positioned in gap 51 of packet 50 in a non-compressive/non-squeezing relationship. As depicted in FIGS. 16A & 16B, during first and subsequent operation of actuator 130, actuator transitions from a first stage to a second stage, when applies a force 133*a* to cup 132 (or button) with a force, compressing bias element 170 (e.g. spring) to move the actuator essentially normal to the longitudinal axis of housing 99, releasing pin 502 from first stop 134*a*' and moving pin (and wedge 501) a predetermined distance to nearest second stop 134*b*' from load by stored energy source 600. Wedge 501 provides a compressive/squeezing relationship with collapsible cavity 152 against upper housing portion 98, urging the contents of the packet towards orifice 110 and exit channel 111. Plurality of second stops 134*b*' are configured for engaging wedge 501 while in the second stage. When user releases actuator cup 132 (e.g. button), bias element 170 returns actuator to first stage (as shown by arrow 133*b* of FIG. 17A), pin 502 is released from second stop 134*b*' and moves to first stop 134*d*' adjacent to first stop 134*a*' (FIG. 17B). Movement of wedge 501 is the distance between two adjacent first stops, the distance providing for a metered amount of material to be dispensed from packet.

Figure 18:
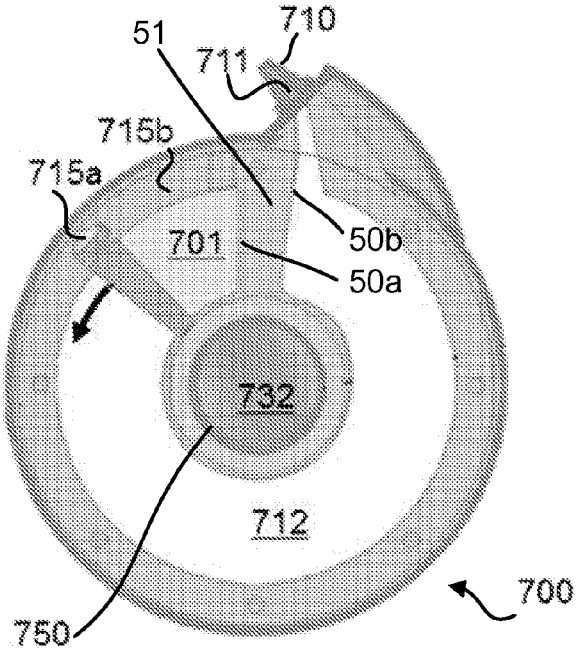
FIG. 18 is a top view of a third exemplary dispenser disclosed and described herein.
Figure 19:
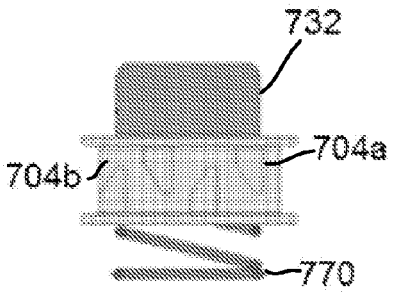
FIG. 19 is an actuator of the dispenser depicted in FIG. 18.

Referring now to FIG. 18 and FIG. 19, an alternate dispenser 700 is depicted, wherein the wedge 715*a* coupled to collar 750 of winder/actuator 732, which is driven around perimeter 715*b* in a similar manner as above for dispenser 100, to compress/squeeze packet 712 positioned between wedge 715*a* and support member 701 and to urge contents of the packet out of channel 711 of orifice 710. Actuator 732 rests on spring 770 to vertically move a plurality of first and second stops 704*a*, 704*b*, respectively, positioned about the outer perimeter of the actuator. Thus, operation of dispenser 700 is similar to that described above.

The portions of the housing, the support member and actuator can be manufactured of plastic or metal. Plastic components can be thermoformed, e.g., injected molded, compression molded, etc. The assembly of the dispensing mechanism and its components can be by hand or automated. The dispenser can be designed for sterilization by autoclave, high-energy radiation, or chemical treatment. In one aspect, the dispenser can be packaged with a supply of packets that the user inserts into the dispenser as need. In another aspect, the dispenser is configured with a single packet already assembled therein and is intended for single use.

Figure 20:
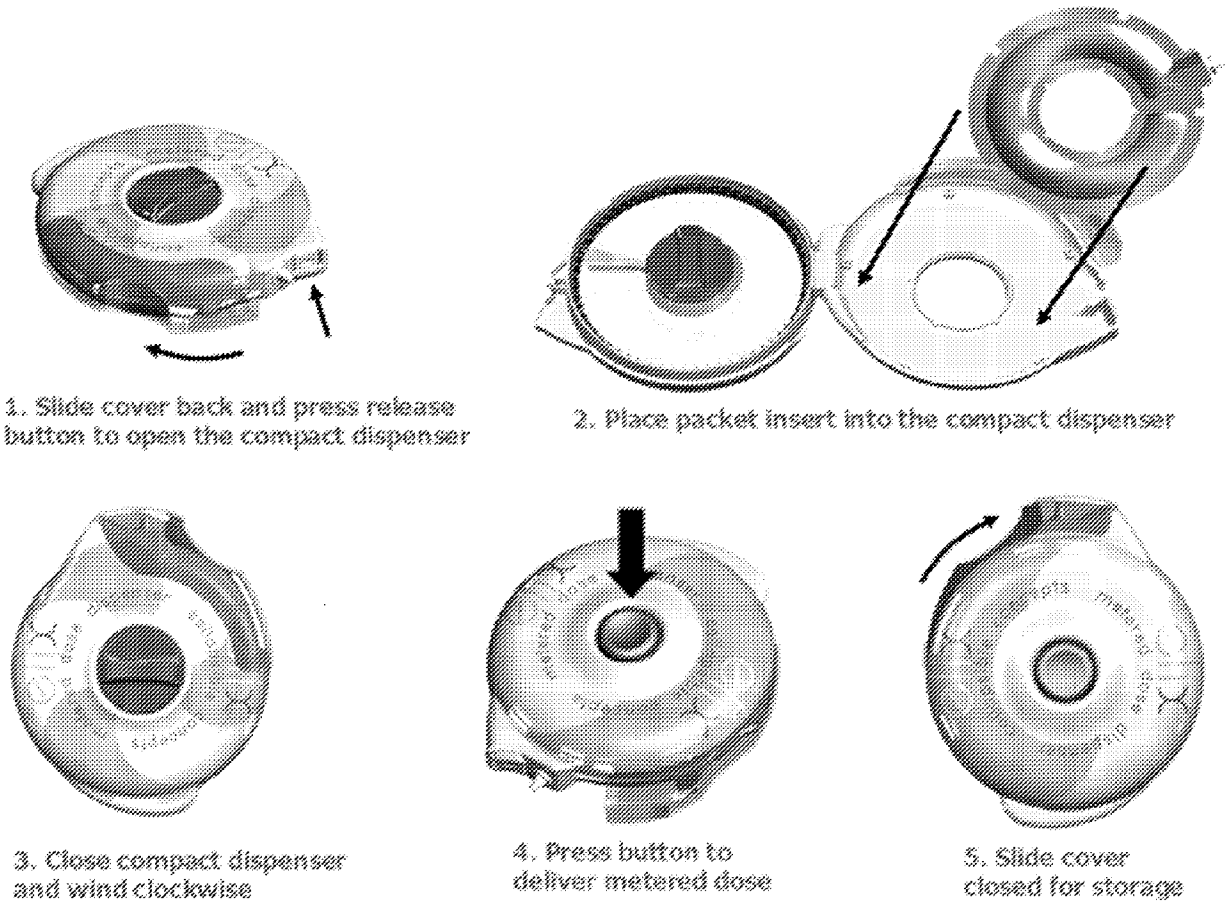
FIG. 20 is a schematic representing the loading and operating of an exemplary dispenser as disclosed and described herein.

Referring now to FIG. 20, a sequence of steps is schematically depicted demonstrating the use of dispenser 100. In step 1, a user would slide cover 140 back and press a release button to open the housing 99 of dispenser 100. In step 2, packet 50 would be inserted to one side of the housing. The dispenser housing portions 99*a*, 99*b* would then be closed and the winder 112 rotated clockwise to provide stored energy, as shown in step 3. Applying a force to actuator 130 delivers a metered amount of material contained in packet 50, as shown in step 4. Cover 140 is slid over wedge for sealing the packet, as shown in step 5.

Figure 21A:
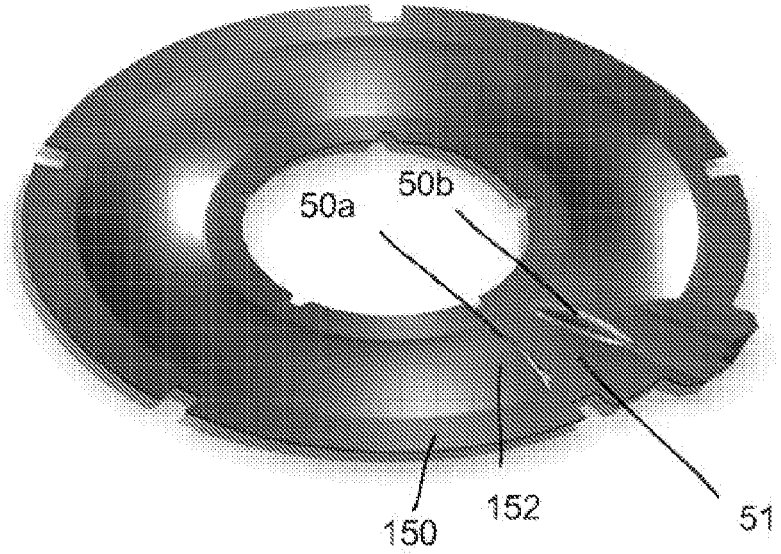
FIGS. 21A and 21B are prospective views of exemplary packet embodiments disclosed and described herein.
Figure 21B:
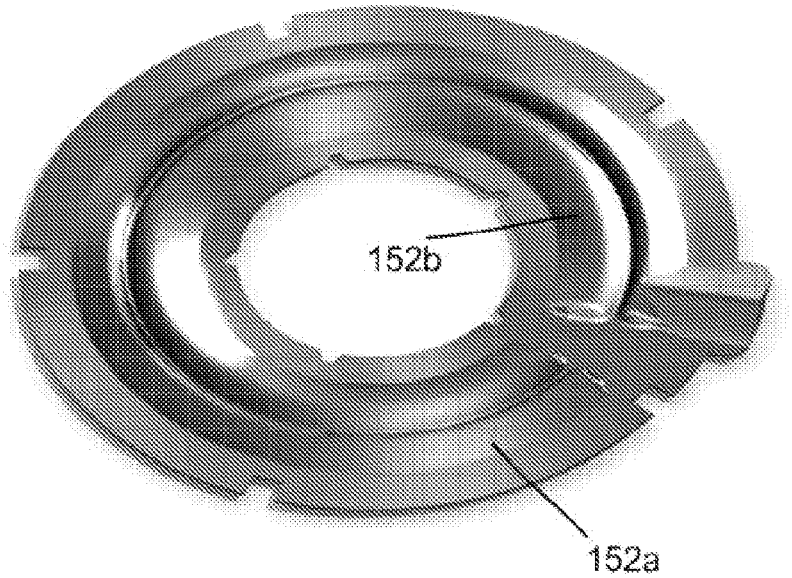

Referring to FIGS. 21A and 21B, various embodiments of a packet with collapsible cavity(s) are depicted. The packet can be a laminate of plastic and/or metal foil sheets or layers sealed together to provide a compressible/squeezable cavity 152 to contain the substance to be dispensed. Multiple cavities can be configured in the laminate sheet, either side-by-side or over-and-under to enable mixing of different materials. Thus, a laminate sheet can be of a single collapsible cavity 152 constructed from laminate sheet 150, or multiple cavities 152*a*, 152*b* can be provided. The laminates of the packet can be sealed together using heat or adhesives as is known in the art. An orifice can be used to fill the packet prior to sealing. The orifice can be sealed with a burstable membrane configured to rupture upon first activation of the dispenser. Packet filling can be performed under aseptic conditions. Orifice can comprise an injection member, such as a needle or cannula, for delivery of a material into a subject. The injection member can be integral with the orifice or be disposable. Collapsible packet can be a laminate of plastic and/or metal foil sheets or layers sealed together to provide a compressible/squeezable cavity to contain the material to be dispensed. Multiple packets can be configured in the laminate sheet, either side-by-side or over-and-under to enable mixing of different materials. Baffles and other distributive and dispersive members can be employed in the packet to provide for mixing. Tapering of the packet adjacent the outlet can be used to facilitate dispensing of very viscous materials.

Figure 22:
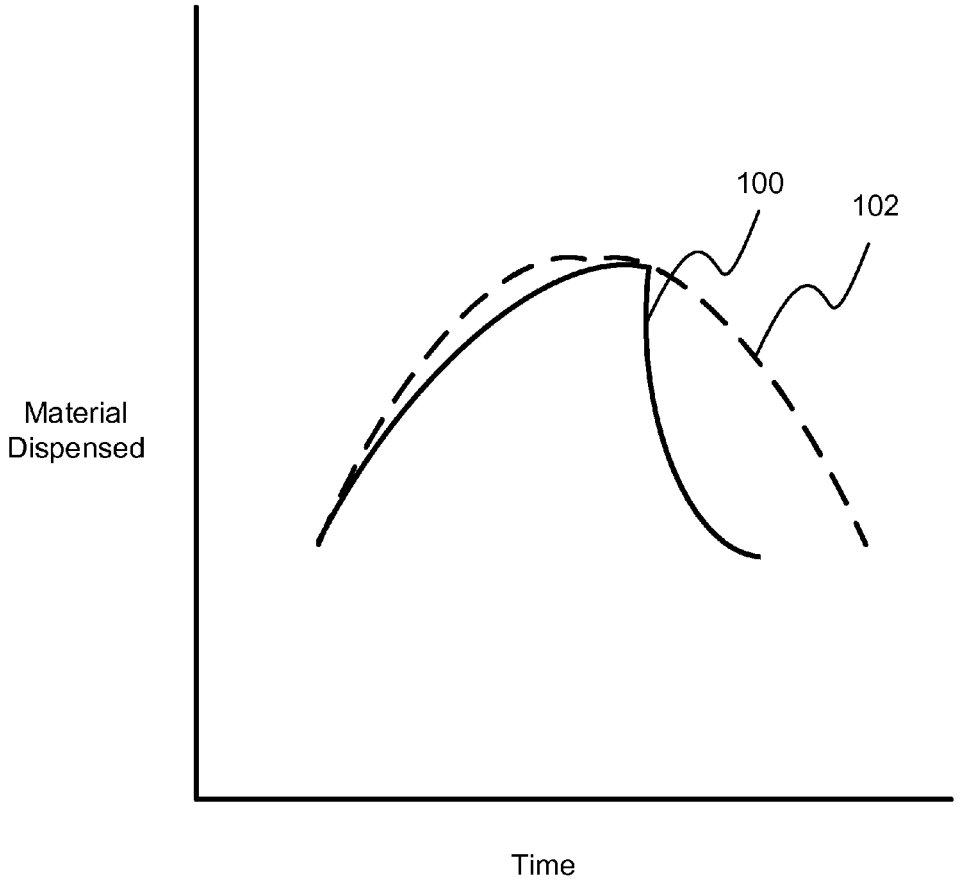
FIG. 22 is a graphical representation of the material dispensed over time for an exemplary dispenser having an anti-drool mechanism verses a similar device without an anti-drool mechanism.

As shown graphically in FIG. 22, material dispensed verses time for a device constructed without anti-drool features is shown by dashed line 102. In contrast, dispenser having anti-drool features, for example, as disclosed and described herein, displays a material dispensing profile that abruptly terminates as the initial force of the dispensing mechanism is relaxed by allowing the reverse direction of the wedge. The anti-drool mechanism can be adjusted to the device configuration and/or the viscosity of the material dispensed. Typically, the more viscous the material, the greater the force required to move the wedge, and thus, the more severe the drooling without anti-drooling mechanisms.

Figure 23:
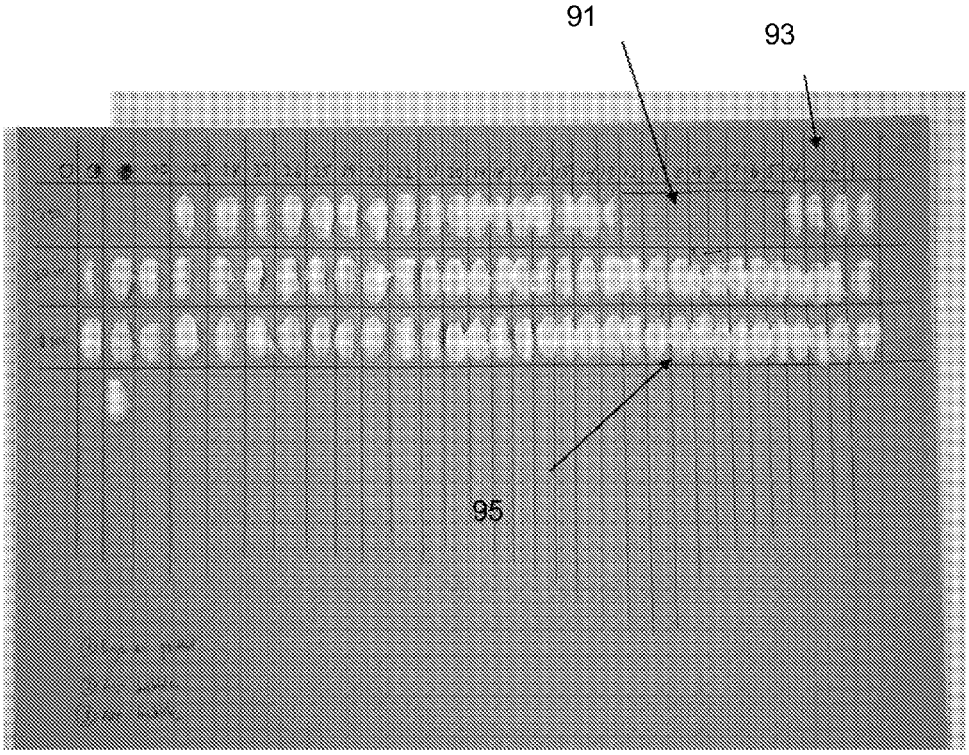
FIG. 23 is dispensing results for a viscous material using the exemplary dispenser disclosed and described herein.

FIG. 23 depicts metered dispensing of a hand lotion cream using dispenser 20. Initially dispensed material 93 is substantially uniform in amount. Air trapped inside packet results in failed dispensing events 91. Dispensed amounts 95 can be correlated with indicia provide on support member 30, viewable by user through window 81 of housing, as described above. Drooling was substantially reduced using stop 31 as described above.

While this disclosure is susceptible to embodiment in different forms, there are shown in the drawings and will herein be described in detail preferred embodiments of the disclosure. It should be understood, however, that the present disclosure is to be considered as an exemplification of the principles of the disclosure and is not intended to limit the disclosure to the embodiments illustrated.

The precise shapes and sizes of the components herein described are not essential to the disclosure unless otherwise indicated. For ease of description, the dispenser of this disclosure will be described in a normal operating position and such terms as up, down, top, bottom, etc. will be used with reference to this position. It will be understood, however, that the dispenser of this disclosure may be manufactured, stored, transported, used and sold in an orientation other than the position described.

All or portions of the housing, the support member and actuator can be manufactured of plastic or metal. Plastic components can be thermoformed, e.g., injected molded, compression molded, etc. The assembly of the dispensing mechanism and its components can be by hand or automated. The dispenser can be designed for sterilization by autoclave, high-energy radiation, or chemical treatment. In one aspect, the dispenser can be packaged with a supply of packets that the user inserts into the dispenser as need. In another aspect, the dispenser is configured with a single packet already assembled therein and is intended for single use.

The substance to be dispensed must be inserted into the packet before it is closed by sealing of the film laminates. In one aspect, the quantity of fluid substance in the packet can be essentially the total capacity of the packet so that essentially no portion of the packet remains filled with a gas, e.g. air. After closure of the laminate, the material in the packet is isolated from the outside until used in conjunction with the dispenser.

The material to be dispensed is not limited to any particular type or any particular end-use. Thus, the material to be dispensed can include any medicament, such as medicaments for skin, mucus membranes, eyes, ears, nose, etc. The medicament can be a liquid, dispersion, suspension, oil-in-water emulsions, water-in-oil emulsions, creams, lotions, ointments, gels, microgels, nanogels, gas, powder, and combinations thereof. For example, medicaments can include medications for the treatment of acne, actinic keratosis, alopecia, cold sores, dermatitis, dermatitis allergic, dermatitis contact, aging, and other disorders of the skin and/or mucus membranes.

In certain aspects, the medicament is an expensive pharmaceutical and/or a readily degradable substance (e.g., by light, heat or oxygen) that is used in small amounts, repetitively, such as topical retinoids, clindamycin-benzoyl peroxide gels, antibiotics, antifungals, and the like. Materials are not limited to pharmaceuticals, and can be cosmetics, cosmeceuticals, perfumes, nutrients, suntan lotion, toothpaste and the like.

The dispenser herein disclosed provides metered dispensing, which in turn allows for accurate dosing of creams, ointments, gels, fluids, etc. In addition, the dispenser is a cost saving and 'green' packaging solution, providing a re-useable dispenser with disposable foil packet inserts, in a novel, attractive, ergonomic design. The dispenser can be configured as a re-useable compact shell. The dispenser provides one-handed activation and product delivery, and dispensing can be provided in any orientation.

The design and configuration of the dispenser allows for delivering a single product or mixing two or more products. The laminate sheet/packet can be configured to provide moisture, light & vapor barrier protection. The laminate sheet/packet also allows for complete dispensing of package contents.

In one aspect, instead of "one shot" injection-device, such as an epi-pen and the like, the dispenser disclosed herein can be configured to allow repeated injection of metered amounts of medication. Moreover, the compact dispenser as disclosed herein is particularly well suited for metered dosing of insulin in treating the symptoms of diabetes. Thus, the diabetic patient can be provided with a lightweight device that includes a readily accessible source of insulin that can be easily refilled or replaced.

Thus, the instant dispenser can serve several other purposes in addition to dispensing a substance. For example, if configured with a needle, it can be used to give an emergency injection, such as a remedy for anaphylaxis, (e.g., epinephrine), or provide an antidote to a chemical agent, (e.g., antivenom, nerve gas antidote, or biochemical threat treatment). A user can wear or carry the dispenser on their person and in the event of need, slide the cover to expose (or attach) the needle, insert the needle into the skin and presses (and release) the actuator to introduce a metered amount of the contents of the dispenser.

While this disclosure is susceptible to embodiment in different forms, there are shown in the drawings and will herein be described in detail preferred embodiments of the disclosure. It should be understood, however, that the present disclosure is to be considered as an exemplification of the principles of the disclosure and is not intended to limit the disclosure to the embodiments illustrated.

We claim:

1. A dispenser for metering a substance, the dispenser comprising:

a housing having a longitudinal axis, the housing configured to receive a packet comprising at least one collapsible cavity containing at least one substance;

a support member with gear teeth positioned in the housing, the support member having a longitudinal axis essentially parallel to the longitudinal axis of the housing;

a wedge coupled to the support member, the wedge configured to move in a plane substantially parallel with the longitudinal axis of the housing;

a bias element exerting a force on the wedge, the force directed substantially normal to the longitudinal axis of the housing; and a reciprocating actuator coupled to the housing and engagable with the gear teeth of the support member, the actuator moveable between an initial position and a first position, wherein the actuator drives the support member in a single predetermined increment upon moving from the initial position to the first position.

2. The dispenser of claim 1, wherein the support member is rotatable within a plane substantially parallel to the longitudinal axis of the housing.

3. The dispenser of claim 1, wherein the wedge rotates in a plane substantially parallel to the longitudinal axis of the housing cooperatively with the movement of the support member.

4. The dispenser of claim 1, wherein the actuator reciprocates in a plane substantially parallel to the longitudinal axis of the housing and cooperatively with the movement of the wedge.

5. The dispenser of claim 1, wherein the bias element is positioned on the support member.

6. The dispenser of claim 5, wherein the bias element is at least one of a spring, a compressed elastomer, a lever, and a living hinge.

7. The dispenser of claim 6, wherein the lever comprises a first end coupled to the support member and a second end coupled to the wedge, the second end operably coupled to the bias element.

8. The dispenser of claim 1, further comprising a pawl pivotably coupled to the actuator, the pawl engaging the gear teeth.

9. The dispenser of claim 8, wherein the pawl is biased against the support member.

10. The dispenser of claim 1, wherein the housing further comprises a stop allowing rotation of the support member in a first direction and substantially preventing rotation in a reverse direction.

11. The dispenser of claim 1, further comprising a packet, the packet comprising the at least one cavity containing at least one substance, the at least one cavity having a first sealed end separated from a second end coupled to an orifice.

12. The dispenser of claim 11, wherein the at least one cavity is annular and the first end separated from the second end by a gap configured to accommodate at least a portion of the wedge.

13. A method of metering the dispensing of substance, the method comprising providing a dispenser as described in claim 1, the dispenser configured to receive a packet comprising at least one collapsible cavity containing at least one substance, the dispenser configured to operate in accordance with the following steps:

(a) moving the actuator relative to the housing from the initial position to the first position; and (b) driving the support member and the wedge a predetermined increment cooperatively with step (a), the wedge configured for collapsing of the cavity of the packet; and (c) metering the dispensing of an amount of the at least one substance.

14. The method of claim 13, wherein the substance comprises at least one of a cream, ointment, liquid, dispersion, suspension, emulsion, gel, paste, or combination thereof.

15. A dispenser for metering a substance, the dispenser comprising:

a housing having a longitudinal axis, the housing configured to receive an annular packet comprising at least one collapsible cavity containing at least one substance;

a support member with gear teeth about the perimeter thereof, the support member positioned in the housing, the support member having a longitudinal axis essentially parallel to the longitudinal axis of the housing, the support member rotatable within a plane substantially parallel to the longitudinal axis of the housing;

a wedge coupled to the support member, the wedge configured to rotate in the plane substantially parallel within the longitudinal axis of the housing and cooperatively with the support member;

a bias element exerting a force on the wedge, the force directed substantially normal to the longitudinal axis of the housing; and a reciprocating actuator coupled to the housing and engagable with a pawl, the pawl operably coupled with the gear teeth of the support member, the actuator moveable between an initial position and a first position wherein upon moving from the initial position the first position, the pawl drives the support member in a single predetermined increment causing the wedge to advance a single predetermined increment collapsing a portion of the cavity;

wherein the actuator reciprocates in a plane substantially parallel to the longitudinal axis of the housing and cooperatively with the rotation of the support member.

* * * * *